US005564491A

United States Patent [19]

Harrington

[11] Patent Number: 5,564,491

[45] **Date of Patent: * Oct. 15, 1996**

[54] METHOD AND APPARATUS FOR TWIN BELT CASTING OF STRIP

[75] Inventor: Donald G. Harrington, Danville, Calif.

[73] Assignee: Kaiser Aluminum & Chemical Corporation, Pleasanton, Calif.

[ * ] Notice: The portion of the term of this patent subsequent to Dec. 23, 2013, has been disclaimed.

[21] Appl. No.: 173,369

[22] Filed: Dec. 23, 1993

Related U.S. Application Data

[63] Continuation-in-part of Ser. No. 902,997, Jun. 23, 1992, abandoned.

[51] Int. Cl.[6] ..... B22D 11/06

[52] U.S. Cl. ..... 164/481; 164/485; 164/432

[58] Field of Search ..... 164/485, 443, 164/429, 431, 432, 479, 481

[56] References Cited

U.S. PATENT DOCUMENTS

| | | | |
|---|---|---|---|
| 2,348,178 | 2/1944 | Merle | 164/479 |
| 2,904,860 | 9/1956 | Hazelett | 164/481 |
| 3,193,888 | 7/1965 | Rochester | 164/432 |
| 4,586,559 | 5/1986 | Govaerts | 164/481 |
| 4,614,218 | 9/1986 | Bedell | 164/432 |
| 4,632,176 | 12/1986 | Pearce | 164/443 |
| 4,817,702 | 4/1989 | Itoyama | 164/432 |
| 4,836,271 | 6/1989 | Reichelt | 164/429 |

FOREIGN PATENT DOCUMENTS

| | | | |
|---|---|---|---|
| 2740477 | 3/1978 | Germany | 164/432 |
| 0077159 | 4/1987 | Japan | 164/481 |
| 0142648 | 5/1990 | Japan | 164/432 |
| 0254517 | 7/1926 | United Kingdom | 164/432 |

*Primary Examiner*—Jack W. Lavinder
*Assistant Examiner*—James Miner
*Attorney, Agent, or Firm*—Rockey, Rifkin and Ryther

[57] ABSTRACT

An apparatus and method for strip casting of metals on at least one endless belt whereby the belt is cooled when it is not in contact with molten metal deposited on its surface.

25 Claims, 3 Drawing Sheets

METHOD AND APPARATUS FOR TWIN BELT CASTING OF STRIP

CROSS-REFERENCE TO RELATED APPLICATION

This application is a continuation-in-part of application Ser. No. 07/902,997, filed June 23, 1992, now abandoned.

BACKGROUND OF THE INVENTION

This invention relates to a method and apparatus for the continuous casting of metals, and particularly the casting of metal strip.

The continuous casting of thin metal strip has been employed with only limited success. By and large, prior processes for the continuous casting of metal strip have been limited to a relatively small number of alloys and products. It has been found that as the alloy content of various metals are increased, as-cast surface quality deteriorates. As a result, many alloys must be fabricated using ingot methods.

In the case of aluminum, relatively pure aluminum product such as foil can be continuously strip cast on a commercial basis. Building products can likewise be continuously strip cast, principally because surface quality in the case of such building products is less critical than in other aluminum products, such as can stock. However, as the alloy content of aluminum is increased, surface quality problems appear, and strip casting has generally been unsuitable for use in making many aluminum alloy products.

A number of strip casting machines have been proposed in the prior art. One conventional device is a twin belt strip casting machine, but such machines have not achieved widespread acceptance in the casting of many metals, and particularly metal alloys with wide freezing ranges. In such twin belt strip casting equipment, two moving belts are provided which define between them a moving mold for the metal to be cast. Cooling of the belts is typically effected by contacting a cooling fluid with the side of the belt opposite the side in contact with the molten metal. As a result, the belt is subjected to extremely high thermal gradients, with molten metal in contact with the belt on one side and a water coolant, for example, in contact with the belt on the other side. The dynamically unstable thermal gradients cause distortion in the belt, and consequently neither the upper nor the lower belt is flat. The product thus produced has areas of segregation and porosity as described below.

Leone, in the *Proceedings Of The Aluminum Association, Ingot and Continuous Casting Process Technology Seminar For Flat Rolled Products*, Vol. II, May 10, 1989, said that severe problems develop if belt stability and reasonable heat flow are not achieved. In the first place, if any area of the belt distorts after solidification of the molten metal has begun and strip shell coherency has been reached, the resulting increase in the gap between the belt and the strip in the distorted region will cause strip shell reheating, or, at least, a locally reduced shell growth rate. That, in turn, gives rise to inverse segregation in the strip which generates interdendritic eutectic exudates at the surface. Moreover, in severe cases with medium and long freezing range alloys, liquid metal is drawn away from a distorted region to feed adjacent, faster solidifying portions of the strip. That in turn causes the surface of the strip to collapse and forms massive areas of shrinkage porosity in the strip which can crack on subsequent rolling or produce severe surface streaks on the rolled surface.

As a result, twin belt casting processes have not generally achieved acceptance in the casting of alloys for surface-critical applications, such as the manufacturing of can stock. Various improvements have been proposed in the prior art, including preheating of the belts as described in U.S. Pat. Nos. 3,937,270 and 4,002,197, continuously applied and removed parting layers as described in U.S. Pat. No. 3,795,269, moving endless side dams as described in U.S. Pat. No. 4,586,559 and improved belt cooling as described in U.S. Pat. Nos. 4,061,177, 4,061,178 and 4,193,440. None of those techniques has achieved widespread acceptance either.

An additional approach to continuous belt casting of steel is described in U.S. Pat. No. 4,561,487 utilizing a pair of counter-rotating belts in which one is chilled while it is not in contact with the metal being cast. Thereafter, a supply of molten steel is supplied to the surface of the belt just before the belt passes downwardly and around a supporting pulley and the metal being cast is passed between the belts. While the approach taken in that patent may avoid the thermal distortion affects caused by large temperature gradients when a cooling fluid is supplied to one side of the belt and the other side of the belt is in contact with hot metal, it presents other problems. The supply of the molten metal to the belt just as it passes around a supporting pulley means that the molten metal must be cooled very quickly; otherwise, molten metal will flow off the belt into the area surrounding the equipment, representing a hazard to workers. In addition, the '487 patent casts the molten metal on a single belt, and uses the second belt only as a "hugger" belt to maintain the cast ribbon in contact with the chilled belt.

Other attempts at belt casting approaches are described in U.S. Pat. No. 3,432,293 and published European Application No. 0,181,566. In the techniques described by both publications, a cooling liquid is applied to the opposite side of a belt on which a metal is cast both while the belt is not in contact with the metal and while it is in contact with the metal. Thus, neither recognizes the concept that the heat transmitted to the belt from the molten metal is substantially removed by application of a cooling fluid at a time when the belt is out of contact with the metal being cast to avoid formation of large thermal gradients.

Another continuous casting process that has been proposed in the prior art is that known as block casting. In that technique, a number of chilling blocks are mounted adjacent to each other on a pair of opposing tracks. Each set of chilling blocks rotates in the opposite direction to form therebetween a casting cavity into which a molten metal such as an aluminum alloy is introduced. The liquid metal in contact with the chilling blocks is cooled and solidified by the heat capacity of the chilling blocks themselves. Block casting thus differs both in concept and in execution from continuous belt casting. Block casting depends on the heat transfer which can be effected by the chilling blocks. Thus, heat is transferred from the molten metal to the chilling blocks in the casting section of the equipment and then extracted on the return loop. Block casters require precise dimensional control to prevent flash (i.e. transverse metal fins) caused by small gaps between the blocks. Such flash causes sliver defects when the strip is hot rolled. As a result, good surface quality is difficult to maintain. Examples of such block casting processes are set forth in U.S. Pat. Nos. 4,235,646 and 4,238,248.

Another technique which has been proposed in continuous strip casting is the single drum caster. In single drum casters, a supply of molten metal is delivered to the surface of a rotating drum, which is internally water cooled, and the molten metal is dragged onto the surface of the drum to form a thin strip of metal which is cooled on contact with the surface of the drum. The strip is frequently too thin for many applications, and the free surface has poor quality by reason of slow cooling and micro-shrinkage cracks. Various improvements in such drum casters have been proposed. For example, U.S. Pat. Nos. 4,793,400 and 4,945,974 suggest grooving of the drums to improve surface quality; U.S. Pat. No. 4,934,443 recommends a metal oxide on the drum surface to improve surface quality. Various other techniques are proposed in U.S. Pat. Nos. 4,771,819, 4,979,557, 4,828,012, 4,940,077 and 4,955,429.

Another approach which has been employed in the prior art has been the use of twin drum casters, such as in U.S. Pat. Nos. 3,790,216, 4,054,173, 4,303,181, or 4,751,958. Such devices include a source of molten metal supplied to the space between a pair of counter-rotating, internally cooled drums. The twin drum casting approach differs from the other techniques described above in that the drums exert a compressive force on the solidified metal, and thus effect hot reduction of the alloy immediately after freezing. While twin drum casters have enjoyed the greatest extent of commercial utilization, they nonetheless suffer from serious disadvantages, not the least of which is an output substantially lower than that achieved in many prior art devices described above. Once again, the twin drum casting approach, while providing acceptable surface quality in the casting of high purity aluminum (e.g. foil), suffers from poor surface quality when used in the casting of aluminum with high alloy content and wide freezing range. Another problem encountered in the use of twin drum casters is center-line segregation of the alloy due to deformation during solidification.

There is thus a need to provide an apparatus and method for continuously casting thin metallic strip at high speeds and improved surface quality as compared to methods currently employed.

In co-pending application Ser. No. 07/902,997, filed Jun. 23, 1992 now abandoned, the disclosure of which is incorporated herein by reference, there is described a method and apparatus where the continuous casting of metal strip, and particularly metal strip formed form highly alloyed aluminum, which overcomes many limitations of the prior art disclosed above. In the method and apparatus there described, uses made of the heat sink capabilities of the belts in a substantially horizontal molding zone in which substantially all of the heat transmitted to the belts from the metal being cast is removed from the belts while the belts are out of contact with the metal being cast. In that way, the method and apparatus described in the foregoing application substantially minimizes the formation of thermal gradients over the thickness of the belts which caused distortion of belts used in the prior art.

In co-pending application Ser. No. 08/173,663, filed concurrently herewith, there is described a method and apparatus for the continuous casting of metal strip which represents a significant improvement in such casting operation. In the method and apparatus there described, each of the twin belts is passed around a pulley, thereby defining a curved surface of the belt followed by a substantial flat surface, both of which define the molding zone between the belts. In accordance with the concepts of that invention, the molten metal is supplied to the molding zone between the belts to the curved surfaces of each of the belts. In the preferred embodiment of that invention, the molten metal solidifies in the molding zone by the time it reaches the nip of the pulleys supporting the belts, that is to say, the point along a line passing through the axis of the pulleys perpendicularly to the belts. As described in that application, it has been found that supplying the molten metal to a curved surface to each of the belts in contact with their respective pulleys minimizes thermal distortion by providing increased stability and minimizes distortion of the belt preceding the nip of the supporting pulleys.

It is an object of the present invention to provide further improvements in which the molten metal is supplied on the curvature of the belts and solidifies substantially before the nip of the entry pulleys while restraining the nip of the pulleys from being displaced by solidified metal. It has been found that the positive control of the gap between the nip of the entry pulleys, combined with solidification prior to the nip, cause a compressive force to be exerted on the cast strip at the nip which in turn serves to even further minimize distortion of the belts and to reduce cracking of the metal.

It is a more specific object of the invention to provide an apparatus and method for the continuous casting of thin metallic strip which provides improved surface quality even when processing metals such as aluminum with high alloy content.

These and other objects and advantages of the invention appear more fully hereinafter from a detailed description of the invention.

SUMMARY OF THE INVENTION

The concepts of the present invention reside in a method and apparatus for strip casting of metals for continuous belt casting in which the molten metal is cast on curved surfaces of a pair of opposing belts so that solidification of the metal occurs prior to the nip between the entry pulleys in the molding zone, and then the entry pulleys at the nip exert a compressive force on the cast metal strip to effect elongation of that strip. It has been found that the features of solidification prior to the nip followed by the exertion of a compressive force by the nip serve to improve the surface quality of the cast metal strip and to reduce the tendency of the strip to crack.

In accordance with the practice of the invention, use is made of a pair of belts mounted adjacent to each other, with each belt being carried on at least two pulleys to define a molding zone therebetween. Each belt passes around an entry pulley whereby each belt defines a curved surface about that pulley and also a substantially flat, and preferably horizontal, surface after the belt passes around the pulley.

In the practice of the invention, there is provided means to supply to the curved surfaces of the belts a molten metal whereby the molten metal solidifies on those opposing curved surfaces in the molding zone prior to the nip of the entry pulleys to form a cast strip of metal having a thickness greater than the thickness of the nip. As a result, the cast metal strip is advanced to the nip where it is subjected to compressive forces to effect elongation of the cast metal strip to thereby improve the surface characteristics of the strip as well as reduce its tendency to crack.

In the preferred embodiment of the invention, each of the belts is heated by heat transfer from the cast metal to the belt. The heat thus transferred to the belt is substantially all removed from the belts while they are out of contact with either the molten metal or the cast strip.

In the practice of the invention, the method and apparatus employed in the practice of the invention utilize a positive control means to control the gap in the molding zone at the nip between the entry pulleys for the twin belts. Such control can be achieved by a variety of mechanisms. For example, it is possible to employ means to exert tension between the axis of the entry pulleys, and by preventing those axes from being displaced one from the other. Such means can be in the form of a hydraulic cylinder to control the gap between the axes of the entry pulleys or like mechanical means such as a mechanical screw jack to control the relative position of the axes of the entry pulleys with respect to each other. Alternatively, use can be made of a spacer block to establish the desired space between the axis of the entry pulleys and a tension member mounted on those axes to prevent displacement of the axes relative to each other.

Thus, in the practice of the invention, the molten metal is supplied to the belt on the curved section around the pulley means. In conventional belt casters of the prior art, the metal is supplied to the belt in the straight section of the belt after it passes around the entry pulley and cooled concurrently from the backside as solidification occurs. It has been found that the supply of molten metal to the curved section of the belt has the advantage increased mechanical stability to resist thermal distortions of the casting belt and thereby maintaining more uniform thickness and better thermal contact between the strip and belt and consequent improvements in the quality of the surface of the cast strip.

The positive control of the nip between the entry pulleys in the molding zone provides improved surface quality in the cast strip. Without limiting the invention as to theory, it is believed that the positive control of the nip between the entry pulleys serves to enhance heat transfer as the molten metal is solidified, thereby minimizing the tendency to form interdendritic eutectic exudates.

In addition, the positive control of the nip between the entry pulleys substantially eliminates cracking of the cast metal strip. Once again, without limiting the present invention as to theory, it is believed that the control of the molding zone at the nip between the entry pulleys also causes the cast metal strip, formed prior to the nip, to be subjected to compressive forces by the entry pulleys, thereby causing the cast metal strip to be elongated. That in turn insures that the cast metal strip is always in compression as distinguished from tension in the molding zone, thus minimizing cracking of the strip due to tension.

The concepts of the present invention can be employed in the strip casting of most metals, including steel, copper, zinc and lead, but are particularly well suited to the casting of thin aluminum alloy strip, while overcoming the problems of the prior art.

BRIEF DESCRIPTION OF THE INVENTION

DETAILED DESCRIPTION OF THE INVENTION

Figure 1:
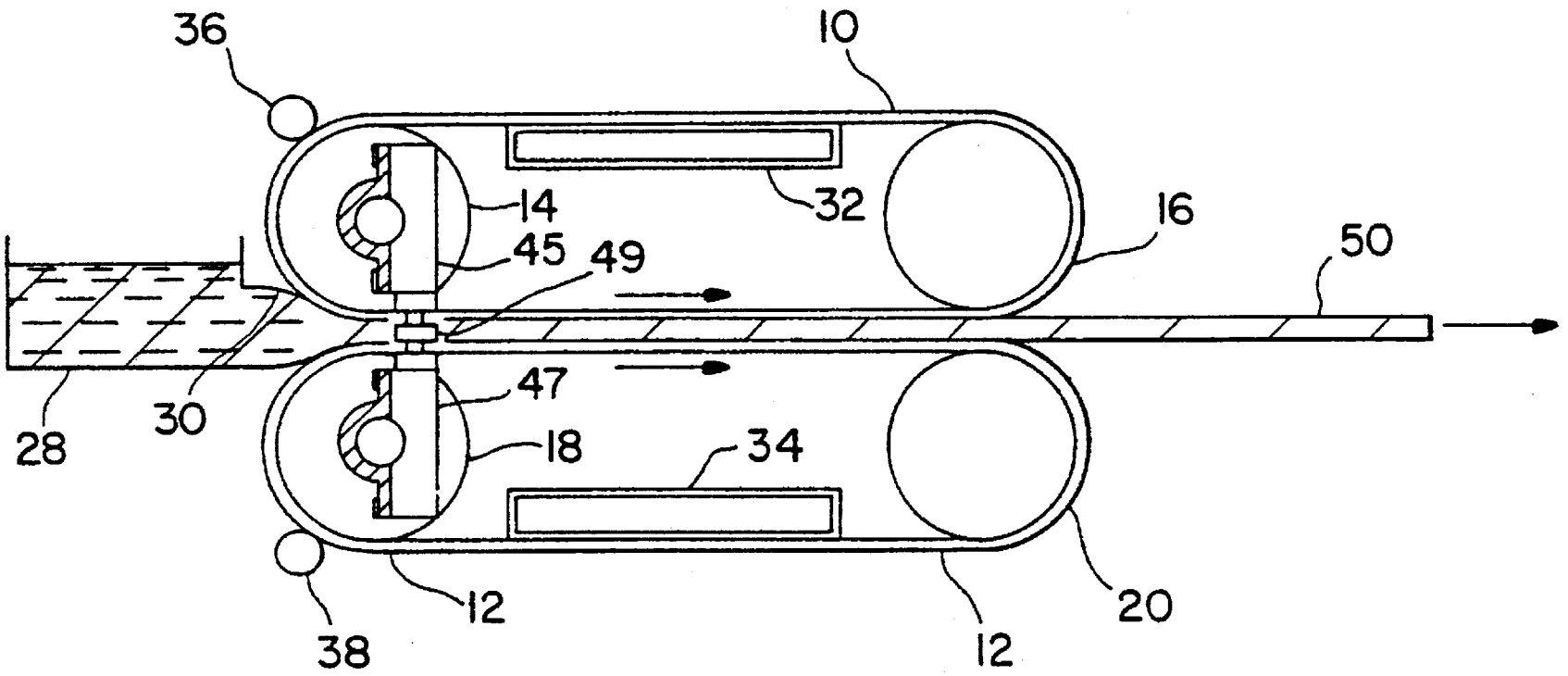
FIG. 1 is a schematic illustration of the casting method and apparatus embodying the present invention.
Figure 2:
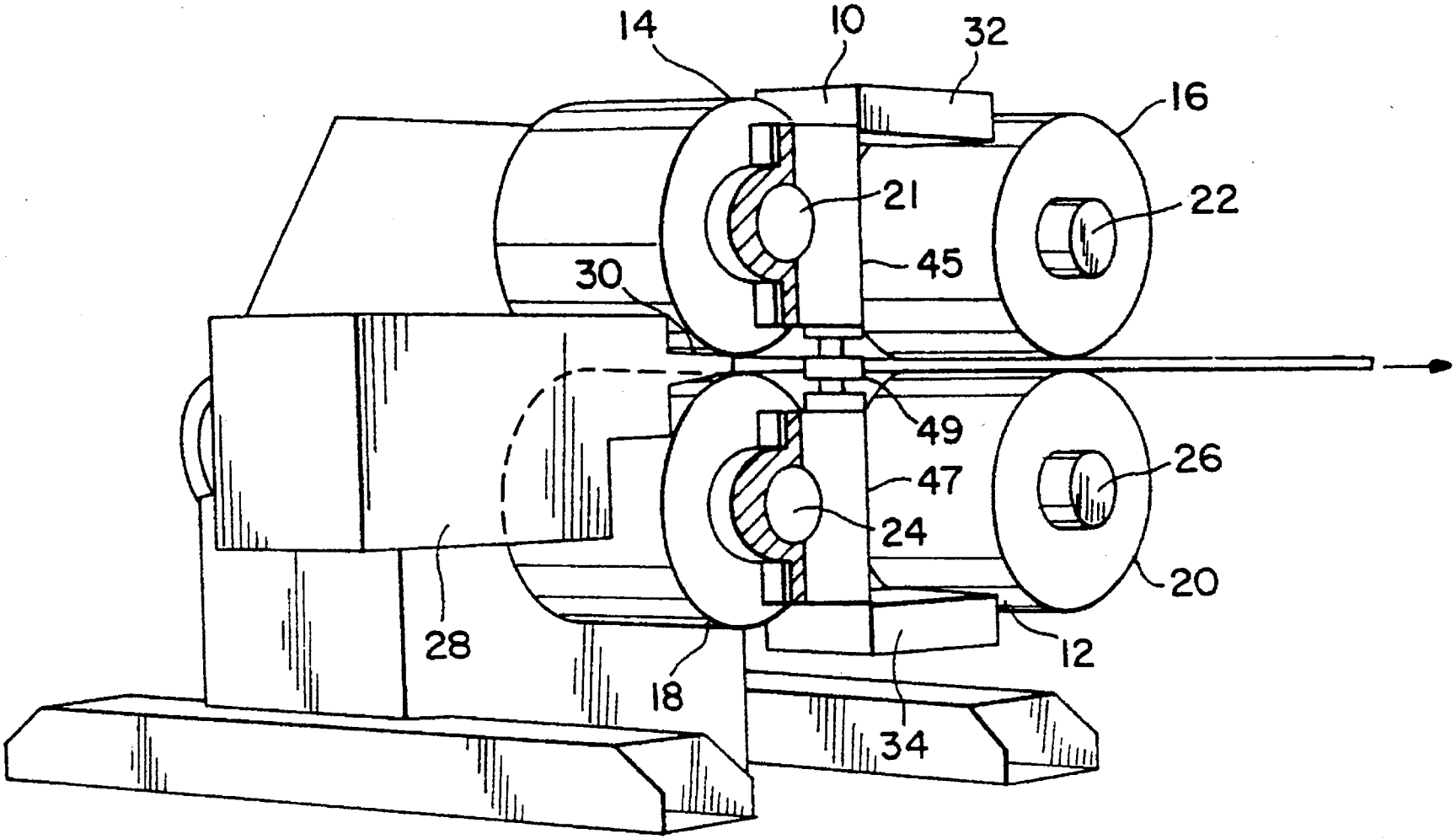
FIG. 2 is a perspective view of one casting apparatus embodying the invention.
Figure 3:
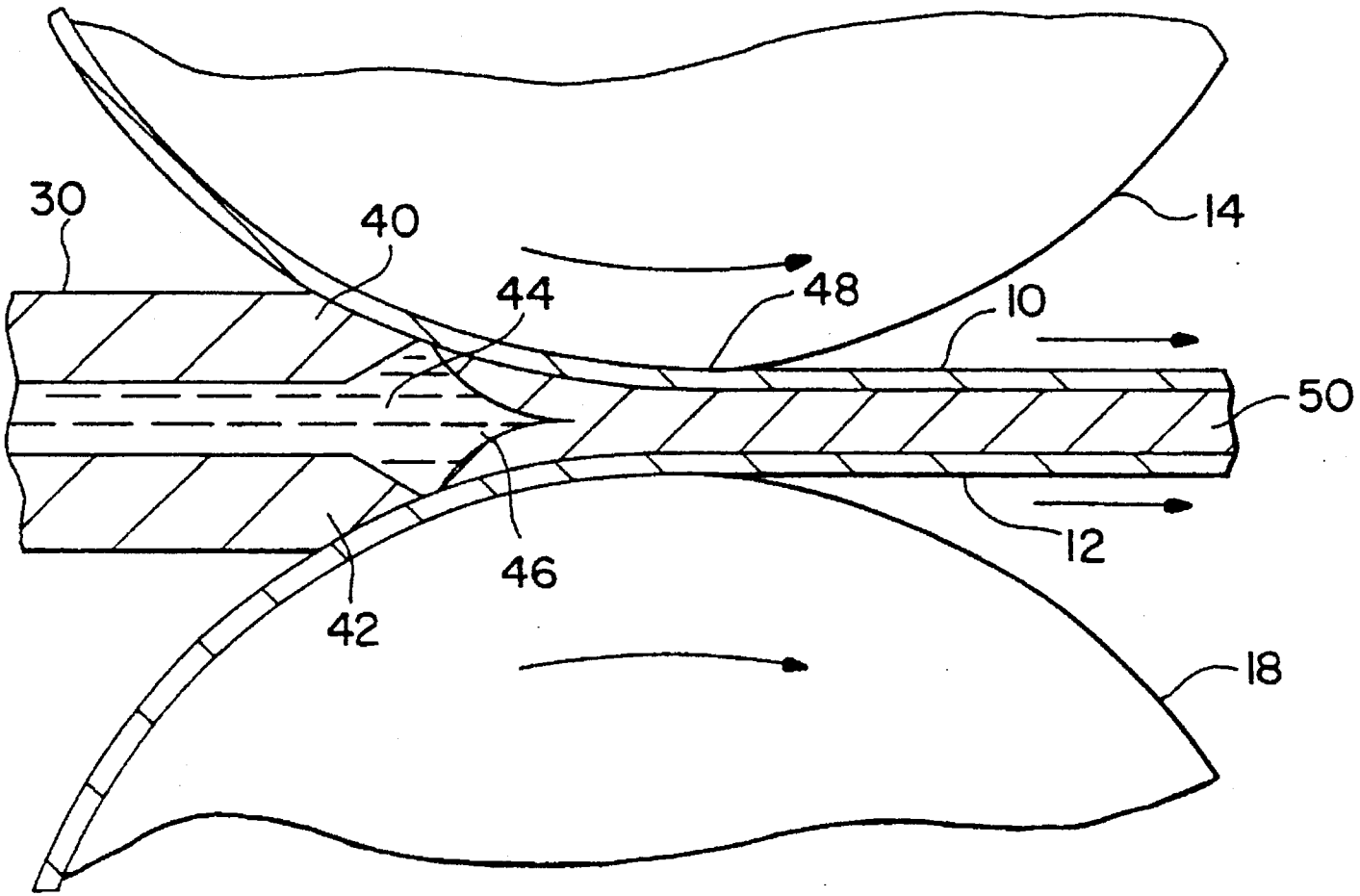
FIG. 3 is a cross-sectional view of the entry of molten metal to the apparatus illustrated in FIGS. 1 and 2.

The apparatus employed in the practice of the present invention is perhaps best illustrated in FIGS. 1, 2 and 3 of the drawings. As there shown, the apparatus includes a pair of endless belts 10 and 12 carried by a pair of upper pulleys 14 and 16 and a pair of corresponding lower pulleys 18 and 20 of FIG. 1. Each pulley is mounted for rotation about an axis 21, 22, 24, and 26 respectively of FIG. 2. The pulleys are of a suitable heat resistant type, and either or both of the upper pulleys 14 and 16 is driven by a suitable motor means not illustrated in the drawing for purposes of simplicity. The same is equally true for the lower pulleys 18 and 20. Each of the belts 10 and 12 is an endless belt, and is preferably formed of a metal which has low reactivity or is non-reactive with the metal being cast. Quite a number of suitable metal alloys may be employed as well known by those skilled in the art. Good results have been achieved using steel and copper alloy belts.

The pulleys are positioned, as illustrated in FIGS. 1 and 2, one above the other with a molding zone therebetween. In the preferred practice of the invention, the gap is dimensioned to correspond to the desired thickness of the metal strip being cast. Thus, the thickness of the metal strip being cast is thus determined by the dimensions of the nip between belts 10 and 12 passing over pulleys 14 and 18 along a line passing through the axis of pulleys 14 and 18 which is perpendicular to the belts 10 and 12. As is described in the earlier co-pending application, the thickness of the strip being cast is limited by the heat capacity of the belts between which the molding takes place.

In accordance with the practice of this invention, there is provided means associated with the entry pulleys 14 and 18 to prevent displacement of those pulleys relative to each other. Any suitable apparatus to rigidly fix the relative positions of pulleys 14 and 18 may be used. FIGS. 1 and 2 illustrate a simple mechanism including a pillow block 45 and 47 on each of the axes 21 and 24 of the entry pulleys 14 and 18, respectively, secured to each other by means of a tension member 49. The tension member may be either fixed or adjustable; it has been found that good results are obtained by simply using a turnbuckle 49 as the tension member to prevent relative displacement of axes 21 and 24 relative to each other. As will be appreciated by those skilled in the art, various other and more sophisticated tension members may likewise be used. For example, use can be made of a hydraulic cylinder as the tension member to prevent relative displacement of the axes 21 and 24 relative to each other. The use of such a hydraulic cylinder has the further advantage that it is adjustable, and thus the tension can be conveniently changed depending on the application and the metal being cast.

Molten metal to be cast is supplied to the molding zone through suitable metal supply means 28 such as a tundish. The inside of tundish 28 corresponds in width to the width of the product to be cast, and can have a width up to the width of the narrower of the belts 10 and 12. The tundish 28 includes a metal supply delivery casting nozzle 30 to deliver a horizontal stream of molten metal to the molding zone between the belts 10 and 12. Such tundishes are conventional in strip casting.

Thus, the nozzle 30, as is best shown in FIG. 3 of the drawings, defines, along with the belts 10 and 12 immediately adjacent to nozzle 30, a molding zone into which the horizontal stream of molten metal flows. Thus, the stream of molten metal flowing substantially horizontally from the nozzle fills the molding zone between the curvature of each belt 10 and 12 to the nip of the pulleys 14 and 18. It begins to solidify and is substantially solidified prior to the point at which the cast strip reaches the nip of pulleys 14 and 18. Supplying the horizontally flowing stream of molten metal to the molding zone where it is in contact with a curved section of the belts 10 and 12 passing about pulleys 14 and 18 serves to limit distortion and thereby maintain better thermal contact between the molten metal and each of the belts as well as improving the quality of the top and bottom surfaces of the cast strip.

In accordance with the preferred embodiment of the invention, the casting apparatus of the invention includes a pair of cooling means 32 and 34 positioned opposite that portion of the endless belt in contact with the metal being cast in the molding gap between belts 10 and 12. The cooling means 32 and 34 thus serve to cool the belts 10 and 12 just after they pass over pulleys 16 and 20, respectively, and before they come into contact with the molten metal. In the most preferred embodiment as illustrated in FIGS. 1 and 2, the coolers 32 and 34 are positioned as shown on the return run of belts 10 and 12, respectively. In that embodiment, the cooling means 32 and 34 can be conventional cooling means such as fluid cooling nozzles positioned to spray a cooling fluid directly on the inside and/or outside of belts 10 and 12 to cool the belts through their thicknesses. In that preferred embodiment, it is sometimes desirable to employ scratch brush means 36 and 38 which frictionally engage the endless belts 10 and 12, respectively, as they pass over pulleys 14 and 18 to clean any metal or other forms of debris from the surface of the endless belts 10 and 12 before they receive molten metal from the tundish 28.

Thus, in the practice of this invention, molten metal flows horizontally from the tundish through the casting nozzle 30 into the casting or molding zone defined between the belts 10 and 12 where the belts 10 and 12 are heated by heat transfer from the cast strip to the belts 10 and 12. The cast metal strip remains between and conveyed by the casting belts 10 and 12 until each of them is turned past the centerline of pulleys 16 and 20. Thereafter, in the return loop, the cooling means 32 and 34 cool the belts 10 and 12, respectively, and remove therefrom substantially all of the heat transferred to the belts in the molding zone. After the belts are cleaned by the scratch brush means 36 and 38 while passing over pulleys 14 and 18, they approach each other to once again define a molding zone.

The most preferred supply of molten metal from the tundish through the casting nozzle 30 is shown in greater detail in FIG. 3 of the drawings. As is shown in that figure, the casting nozzle 30 is formed of an upper wall 40 and a lower wall 42 defining a central opening 44 therebetween whose width may extend substantially over the width of the belts 10 and 12 as they pass around pulleys 14 and 18, respectively.

The distal ends of the walls 40 and 42 of the casting nozzle 30 are in substantial proximity of the surface of the casting belts 10 and 12, respectively, and define with the belts 10 and 12 a casting cavity or molding zone 46 into which the molten metal flows through the central opening 44. As the molten metal in the casting cavity 46 flows between the belts 10 and 12, it transfers its heat to the belts 10 and 12, simultaneously cooling the molten metal to form a solid strip 50 maintained between casting belts 10 and 12.

In the preferred practice of the invention, sufficient setback (defined as the distance between first contact 47 of the molten metal 46 and the nip 48 defined as the closet approach of the entry pulleys 14 and 18) should be provided to allow substantially complete solidification prior to the nip 48. In prior art belt casters, the molten metal contacts the belt after the nip 48 in the straight section. Hence, in the present invention solidification is substantially complete prior to the nip 48.

The importance of freezing before the nip 48 in the present invention is that the belts 10 and 12 are much more stable when held in tension on the curved surface of the pulley and distort much less than if the molten metal 46 first contacts the belts 10 and 12 in the straight section as in prior art. Moreover, in the practice of the present invention, there is a momentary high thermal gradient over the belts 10 and 12 when first contacted by molten metal 46. Because each belt is in tension and is well supported prior to the nip by the pulleys 14 and 18, the belts are more stable against distortion arising from that momentary thermal gradient. In addition, the space between the belts at the time that they first come into contact with the molten metal is substantially larger then the gap between the belts corresponding to the thickness of the cast strip. As a result, any distortion in the belts have little effect on the metal being cast at that location. The high thermal gradient largely dissipates before the belts 10 and 12 reach the nip 48, and thus any distortions that do occur diminish as the belts approach the nip.

The importance of freezing or solidification before the nip 48 also arises from the fact that as shown in FIG. 3 of the drawings, the metal solidifying between the curved surfaces in the molding zone prior to the nip has a dimension or thickness greater than the corresponding dimension or thickness of the nip itself. That insures that when the solidified cast metal is advanced to the nip 48, it has a larger dimension than that of the nip, thereby insuring that the nip 48 exerts a compressive force on the cast metal strip and thereby cause elongation to improve not only surface characteristics but also to reduce the tendency of the strip to crack. In addition, the compressive force exerted on the cast metal strip after solidification between the point of solidification and the nip itself insures good thermal contact between the cast metal strip and the belts.

The amount of compressive force is not critical to the practice of the invention. It has been found that the compressive force should be sufficiently high as to insure good thermal contact between the cast metal strip and the belt as well as sufficiently high so as to cause elongation. The elongation is preferably sufficient to insure that the cast metal strip, while it is conveyed from the nip 48 through the remainder of the molding zone, is in a state of compression as distinguished from tension. As is described herein above, it has been found that maintaining the cast strip under compressive force serves to minimize cracking that would otherwise occur if the cast strip were maintained under tension. In general, it is desirable that the percent elongation be relatively low, generally below 15 percent, and most preferably below 10 percent. Good results have been achieved by the practice of the invention when the percent elongation is less than 5 percent.

The thickness of the strip that can be cast is, as those skilled in the art will appreciate, related to the thickness of the belts 10 and 12, the return temperature of the casting belts and the exit temperature of the strip and belts. In addition, the thickness of the strip depends also on the metal being cast. It has been found that aluminum strip having a thickness of 0.100 inches using steel belts having a thickness of 0.08 inches provides a return temperature of 300° F. and an exit temperature of 800° F. The interrelationship of the exit temperature with belt and strip thickness is described in detail in co-pending application Ser. No. 07/902,997 now abandoned. For example, for casting aluminum strip for a thickness of 0.100 using a steel belt having a thickness of 0.06 inches, the exit temperature is 900° F. when the return temperature is 300° F. and the exit temperature is 960° F. when the return temperature is 400° F.

One of the advantages of the method and apparatus of the present invention is that there is no need to employ a thermal barrier coating on the belts to reduce heat flow and thermal stress, as is typically employed in the prior art. The absence of fluid cooling on the back side of the belt while the belt is in contact with hot metal in the molding zone significantly reduces thermal gradients and eliminates problems of film boiling occurring when the critical heat flux is exceeded. The method and apparatus of the present invention also minimizes cold framing, a condition where cold belt sections exist in three locations of (1) before metal entry and (2) on each of the two sides of mold zone of the belt. Those conditions can cause severe belt distortion.

In addition, the concepts of the present invention also obviate the need to employ parting agents as have been used in the prior art to prevent sticking of the cast metal strip to either of the belts.

For some applications, it can be desirable to employ one or more belts having longitudinal grooves on the surface of the belt in contact with the metal being cast. Such grooves have been used in single drum casters as described in U.S. Pat. No. 4,934,443.

What is claimed is:

1. Apparatus for strip casting of metals by continuous belt casting comprising:

(a) a pair of continuous, entry belts formed of heat conductive material, said belts positioned adjacent each other to define a molding zone therebetween;

(b) a pair of at least two pulley means including an entry pulley, each of said belts being mounted on one pulley means and passing around an entry pulley means whereby the belts define a curved surface about said entry pulley and a substantially flat surface after the belt passes around the entry pulley, with the belts passing around the entry pulleys defining a nip therebetween, said nip lying in a plane defined by the axes of the entry pulleys substantially perpendicular to the belts;

(c) means for supplying to said curved surface of said belts in the molding zone a molten metal whereby the molten metal substantially solidifies in the molding zone prior to the nip between the belts abut the entry pulleys; and (d) means associated with the entry pulleys to control the spacing therebetween and effect a compressive force on the substantially frozen cast strip at the nip sufficient to cause elongation thereof so that the cast strip is in compression in the direction of travel after exiting from the nip to minimize cracking of the cast strip.

2. Apparatus as defined in claim 1 which includes cooling means positioned adjacent to each of said belts when said belts are not in contact with either the molten metal or the cast metal, said cooling means serving to reduce the temperature of the belts by removing, when the belts are not in contact with either the metal or the cast strip, substantially all of the heat transferred by the molten metal and the cast metal to the belts.

3. Apparatus as defined in claim 2 wherein the cooling means includes means for applying a cooling fluid on the endless belts.

4. Apparatus as defined in claim 1 wherein the means for supplying molten metal includes tundish means having a nozzle positioned to deposit molten metal on the curved surfaces of said endless belts.

5. Apparatus as defined in claim 1 which includes means for advancing each of said belts about the pulleys.

6. Apparatus as defined in claim 1 wherein the endless belts are formed of a heat conductive metal.

7. Apparatus as defined in claim 1 which includes edge containment means to prevent flow of molten metal beyond the edge of said belt.

8. Apparatus as defined in claim 1 wherein each belt defines a substantially flat horizontal surface after the belt passes around said pulley means.

9. Apparatus for strip casting of metals by continuous belt casting comprising:

(a) a pair of continuous entry belts formed of heat conductive material, said belts being positioned adjacent each other to define a molding zone therebetween;

(b) a pair of at least two pulley means including an entry pulley, each of said belts being mounted on one pulley means and passing around the entry pulley whereby each belt defines a curved surface about the entry pulley and a substantially flat surface after each belt passes around the entry pulley, with the belts passing around the entry pulleys defining a nip therebetween, said nip lying in a plane defined by the axes of the entry pulleys substantially perpendicular to the belts;

(c) means for supplying to said curved surfaces of said belts a molten metal whereby the molten metal substantially solidifies in the molding zone prior to the nip between the entry pulleys between the belts to form a cast strip of metal having a thickness greater than the distance between the nip, and;

(d) means associated with the entry pulleys to control the spacing therebetween and effect a compressive force on the substantially frozen cast strip at the nip sufficient to cause elongation thereof so that the cast strip is in compression in the direction of travel after exiting from the nip to minimize cracking of the cast strip.

10. Apparatus as defined in claim 9 wherein the means for supplying molten metal includes tundish means having a nozzle positioned to deposit molten metal on the curved surfaces of said endless belts.

11. Apparatus as defined in claim 9 which includes cooling means positioned adjacent to each of said belts are not in contact with either the molten metal or the cast metal, said cooling means serving to reduce the temperature of the belts by removing, when the belts are not in contact with either the metal or the cast strip, substantially all of the heat transferred by the molten metal and the cast metal to the belts.

12. Apparatus as defined in claim 11 wherein the endless belts are formed of a heat conductive metal.

13. Apparatus for strip casting of metals by continuous belt casting comprising:

(a) a pair of continuous entry belts formed of heat conductive material, said belts being positioned adjacent each other to define a molding zone therebetween;

(b) a pair of least two pulley means including an entry pulley, each of said belts being mounted on the pulley means and passing around the entry pulley whereby the belts each define a curved surface about said entry pulley and a substantially flat surface after each belt passes around the entry pulley, the belts passing around the entry pulleys defining a nip therebetween, said nip lying in a plane defined by the axes of the entry pulleys substantially perpendicular to the belts;

(c) tundish nozzle means in proximity to the belts for supplying to said curved surfaces of said belts a substantially horizontal stream of molten metal whereby the molten metal substantially solidifies in the molding zone between the belts to form a cast strip of metal, having a thickness greater than the distance between the nip;

(d) means to control the spacing between the belts at the nip and effect a compressive force on the substantially frozen cast strip at the nip sufficient to cause elongation thereof so that the cast strip is in compression in the direction of travel after exiting from the nip to minimize cracking of the cast strip.

14. Apparatus for strip casting of metals by continuous belt casting comprising:

(a) a pair of continuous belts formed of a heat conductive material mounted one above the other;

(b) at least two pulley means including an entry pulley for each belt, each of said belts being mounted on the pulley means and passing around the entry pulley whereby each belt defines a curved surface about the entry pulley and a substantially flat surface after the belt passes around the entry pulley for each belt, said curved surfaces of the belts and the substantially flat surfaces of each belts defining a molding zone between the belts, the belts passing around the entry pulleys defining a nip therebetween, said nip lying in a plane defined by the axes of the entry pulleys substantially perpendicular to the belts;

(c) means for supplying to said curved surface of each belt a molten metal whereby the molten metal substantially solidifies in the molding zone between the belts prior to the time the metal reaches the nip of the belts to form a cast strip of metal, having a thickness greater than the distance between the nip;

(d) means to control the spacing of the nip and effect a compressive force on the substantially frozen cast strip at the nip to cause elongation thereof so that the cast strip is in compression in the direction of travel after exiting from the nip to minimize cracking of the cast strip; and (e) cooling means positioned adjacent to the belts for cooling the belts when the belts are not in contact with either the molten metal or the cast metal, said cooling means serving to reduce the temperature of the belts by removing, when the belts are not in contact with either the metal or the cast strip, substantially all of the heat transferred by the molten metal and the cast metal to the belts.

15. Apparatus for strip casting of metals by continuous belt casting comprising:

(a) a pair of continuous belts formed of a heat conductive material mounted one above the other, said belts substantially horizontal and defining a molding zone therebetween;

(b) a pair of pulley means including an entry pulley for each belt, each of said belts being mounted on the pulley means and passing around the entry pulley whereby the belt defines a curved surface about the entry pulley and a substantially flat surface after the belt passes around the entry pulley for each belt, the belts passing around the entry pulleys defining a nip therebetween, said nip lying in a plane defined by the axes of the entry pulleys substantially perpendicular to the belts;

(c) nozzle means defining, along with said curved surfaces and said flat surfaces of said belts, a molding zone, said nozzle means for supplying to said curved surface of each belt in the molding zone a molten metal whereby the molten metal substantially solidifies in the molding zone between the belts prior to the time the metal reaches the nip of the belts to form a cast strip of metal, having a thickness greater than the distance between the nip;

(d) means associated with the entry pulleys to control the spacing therebetween and effect a compressive force on the substantially frozen cast strip at the nip sufficient to cause elongation thereof so that the cast strip is in compression in the direction of travel after exiting from the nip to minimize cracking of the cast strip.

16. Apparatus as defined in claim 15 which includes cooling means positioned adjacent to the belt for cooling the belt when the belt is not in contact with either the molten metal or the cast metal, said cooling means serving to reduce the temperature of the belt by removing, when the belt is not in contact with either the metal or the cast strip, substantially all of the heat transferred by the molten metal and the cast metal to the belt.

17. Apparatus as defined in claim 15 which includes tension means connected to the axis of each entry pulley to prevent displacement of the entry pulleys away from each other.

18. Apparatus for strip casting of metals by continuous belt casting comprising:

(a) a pair of continuous, entry belts formed of heat conductive material, said belts positioned adjacent each other to define a molding zone therebetween, said nip line in a plane defined by the axes of the entry pulleys substantially perpendicular to the belts;

(b) a pair of at least two pulley means including an entry pulley, each of said belts being mounted on one pulley means and passing around an entry pulley means whereby the belts define a curved surface about said entry pulley and a substantially flat surface after the belt passes around the entry pulley, with a nip between the belts about the entry pulleys;

(c) means for supplying to said curved surface of said belts in the molding zone a molten metal whereby the molten metal solidifies in the molding zone prior to the nip between the entry pulleys; and (d) means associated with the entry pulleys to control the spacing therebetween and effect a compressive force on the substantially frozen cast strip at the nip sufficient to cause elongation thereof so that the cast strip is in compression in the direction of travel after exiting from the nip to minimize cracking of the cast strip.

19. A method for casting of metals by continuous belt casting comprising the steps of:

(a) moving a pair of entry belts formed of heat conductive material around a pair of entry pulleys defining a nip therebetween, with the nip lying in a plane defined by the axes of the entry pulleys substantially perpendicular to the belt whereby the belts define a molding zone therebetween and, each belt, as it passes over the entry pulley, defines a curved surface;

(b) supplying to the curved surfaces of each of the belts a molten metal whereby the molten metal substantially solidifies in the molding zone to form a strip of cast metal having a thickness greater than the thickness of the nip; and (c) advancing the cast strip to the nip to effect a compressive force on the substantially frozen cast strip at the nip sufficient to cause elongation thereof so that the cast strip is in compression in the direction of travel after exiting from the nip to minimize cracking of the cast strip.

20. A method as defined in claim 19 wherein the molten metal is supplied to a substantially horizontal molding zone.

21. A method as defined in claim 19 wherein the molten metal is supplied in a substantially horizontal stream to the molding zone.

22. A method as defined in claim 19 wherein said metal is an aluminum alloy.

23. A method as defined in claim 19 which includes the step of cooling the belt to remove the heat transfer to the belt from the molten metal and the cast metal when the belts are not in contact with the molten metal or the cast metal and before the belts receive additional molten metal.

24. A method as defined in claim 19 wherein the compressive force is sufficient to effect less than 15% elongation of the cast strip.

25. A method for casting of metals and continuous belt casting comprising the steps of:

(a) moving a pair of entry belts formed of heat conductive metal around a pair of entry pulleys defining a nip therebetween, with the nip lying in a plane defined by the axes of the entry pulleys substantially perpendicular to the belts, whereby the belts define a molding zone therebetween and each belt, as it passes over the entry pulleys, defines a curved surface;

(b) supplying to the curved surface of each of the belts a molten metal whereby the molten metal substantially solidifies prior to the nip to form a strip of cast metal having a thickness greater than the gap at the nip;

(c) advancing the cast strip to the nip to effect a compressive force on the substantially frozen cast strip at the nip sufficient to cause elongation thereof so that the cast strip is in compression in the direction of travel after exiting from the nip to minimize cracking of the cast strip; and (d) cooling each of the belts to substantially remove the heat transfer to the belt from the molten metal and the cast strips when the belts are not in contact with the molten metal or the cast strip.

* * * * *

UNITED STATES PATENT AND TRADEMARK OFFICE

CERTIFICATE OF CORRECTION

PATENT NO. : 5,564,491
DATED : October 15, 1996
INVENTOR(S) : Donald G. Harrington It is certified that error appears in the above-indentified patent and that said Letters Patent is hereby corrected as shown below:

In claim 1, column 9, line 3, delete "entry" and insert therefor--endless--.

In claim 9, column 10, line 6, delete "entry" and insert therefor--endless--.

In claim 13, column 10, line 46, delete "entry" and insert therefor--endless--.

In claim 13, column 10, line 49, between "a pair of" and "least" insert --at--.

Signed and Sealed this

Eighth Day of April, 1997

Bruce Lehman

*Attest:*

BRUCE LEHMAN

*Attesting Officer*

*Commissioner of Patents and Trademarks*